US009580985B2

(12) United States Patent
Fuhst et al.

(10) Patent No.: US 9,580,985 B2
(45) Date of Patent: Feb. 28, 2017

(54) METHOD OF CUTTING A CONTROL LINE OUTSIDE OF A TUBULAR

(71) Applicants: Karsten Fuhst, Giesen (DE); Keat Hoong Wong, Singapore (SG)

(72) Inventors: Karsten Fuhst, Giesen (DE); Keat Hoong Wong, Singapore (SG)

(73) Assignee: Baker Hughes Incorporated, Houston, TX (US)

( * ) Notice: Subject to any disclaimer, the term of this patent is extended or adjusted under 35 U.S.C. 154(b) by 753 days.

(21) Appl. No.: 13/955,530

(22) Filed: Jul. 31, 2013

(65) Prior Publication Data

US 2014/0033885 A1 Feb. 6, 2014

Related U.S. Application Data

(60) Provisional application No. 61/679,486, filed on Aug. 3, 2012.

(51) Int. Cl.
*E21B 29/04* (2006.01)

(52) U.S. Cl.
CPC ..... *E21B 29/04* (2013.01); *Y10T 83/05* (2015.04); *Y10T 83/0524* (2015.04); *Y10T 83/0596* (2015.04)

(58) Field of Classification Search
CPC ..... E21B 29/005; E21B 29/04; Y10T 83/05; Y10T 83/0596; Y10T 83/4789
See application file for complete search history.

(56) References Cited

U.S. PATENT DOCUMENTS

| | | | | |
|---|---|---|---|---|
| 3,225,828 | A | 12/1965 | Wisenbaker et al. | |
| 4,424,629 | A | 1/1984 | Schott | |
| 6,626,074 | B1 | 9/2003 | Wheeler | |
| 6,821,063 | B2 * | 11/2004 | Debat | B23C 3/02 409/132 |
| 7,478,982 | B2 | 1/2009 | Fuhst et al. | |
| 7,537,055 | B2 | 5/2009 | Head et al. | |
| 7,575,056 | B2 | 8/2009 | Fuhst et al. | |
| 7,628,205 | B2 | 12/2009 | Fuhst et al. | |
| 7,802,949 | B2 | 9/2010 | Fuhst et al. | |

(Continued)

OTHER PUBLICATIONS

International Search Report and Written Opinion issued in related International Application No. PCT/US2013/053343; dated Oct. 23, 2013; 10 pages.

*Primary Examiner* — Shane Bomar
(74) *Attorney, Agent, or Firm* — Bracewell LLP; Keith R. Derrington

(57) ABSTRACT

A method of cutting a control line mounted on an outer surface of a downhole tubular that includes providing a cutting tool having a main body, and a cutting head on a lower end of the body that rotates with respect to the body. A cutting blade is on a lower end of the cutting head, which is rotatable by a motor, where the blade is selectively pivoted radially outward from an axis of the cutting head. As the cutting head rotates, the cutting blade orbits within the tubular axially offset from the axis. When the tool is inserted into the tubular, the radial offset of the blade is controlled so it pivots radially outward into contact with the tubular when the blade approaches an azimuthal area proximate the control line. The cutting blade is retracted when its orbit moves it past the azimuthal area proximate the control line.

15 Claims, 4 Drawing Sheets

(56) References Cited

U.S. PATENT DOCUMENTS

| | | | | |
|---|---|---|---|---|
| 7,823,632 | B2 * | 11/2010 | McAfee | E21B 29/005 166/55.7 |
| 7,954,564 | B2 | 6/2011 | Makkar et al. | |
| 7,987,901 | B2 | 8/2011 | Krueger et al. | |
| 8,113,271 | B2 | 2/2012 | Fuhst et al. | |
| 2009/0294127 | A1 | 12/2009 | Krueger et al. | |
| 2010/0170675 | A1 * | 7/2010 | Daigle | E21B 29/04 166/298 |
| 2011/0147008 | A1 * | 6/2011 | Brown | E21B 17/026 166/377 |
| 2011/0192589 | A1 * | 8/2011 | Fuhst | E21B 29/005 166/55 |
| 2011/0247881 | A1 * | 10/2011 | Orban | E21B 7/061 175/244 |
| 2011/0297379 | A1 | 12/2011 | Laird et al. | |
| 2013/0233139 | A1 * | 9/2013 | Trudeau | B23D 21/14 83/54 |
| 2014/0000428 | A1 * | 1/2014 | Cairns | B23D 59/006 83/14 |
| 2015/0211314 | A1 * | 7/2015 | McAfee | E21B 29/005 166/250.01 |

* cited by examiner

METHOD OF CUTTING A CONTROL LINE OUTSIDE OF A TUBULAR

CROSS REFERENCE TO RELATED APPLICATIONS

This application claims priority to and the benefit U.S. Provisional Application Ser. No. 61/679,486, filed Aug. 3, 2012 the full disclosure of which is hereby incorporated by reference herein for all purposes.

BACKGROUND OF THE INVENTION

1. Field of the Invention

The disclosure herein relates generally to the field of severing a control line downhole. More specifically, the present disclosure relates to a method of cutting a control line that is set outside of a downhole tubular; and without severing the tubular.

2. Description of Related Art

Tubular members, such as production tubing, coiled tubing, drill pipe, casing for wellbores, pipelines, structural supports, fluids handling apparatus, and other items having a hollow space can be severed from the inside by inserting a cutting device within the hollow space. As is well known, hydrocarbon producing wellbores are lined with tubular members, such as casing, that are cemented into place within the wellbore. Additional members such as packers and other similarly shaped well completion devices are also used in a wellbore environment and thus secured within a wellbore. From time to time, portions of such tubular devices may become unusable and require replacement. When it is determined that a tubular needs to be severed, either for repair, replacement, demolishment, or some other reason, a cutting tool can be inserted within the tubular, positioned for cutting at the desired location, and activated to make the cut. These cutters are typically outfitted with a blade or other cutting member for severing the tubular. In the case of a wellbore, where at least a portion of the casing is in a vertical orientation, the cutting tool is lowered into the casing to accomplish the cutting procedure. Men at a designated depth in the tubular, the blade is deployed radially outward into cutting contact with the inner surface of the tubular and rotated about an axis of the tubular so the tubular is severed along its entire circumference.

Communication between the surface and downhole is often provided via control lines deployed adjacent downhole tubulars. The control lines may be electrical, fiber optic, hydraulic flow lines and the like. The communication generally includes data conveyed from downhole to the surface for evaluation of the associated wellbore, and control signals from the surface to actuate devices, such as valves, disposed in a well string in the wellbore. Cutting a control line might he necessary if downhole equipment, like a packer, has to be retrieved. The control line is typically severed at the same depth as the tubing, because severing the control line above the tubing could interfere with a subsequent fishing operation.

BRIEF SUMMARY OF THE INVENTION

Disclosed herein are example methods of operating in a wellbore tubular. In one example a cutting tool having a cutting blade is provided and is deployed to a designated location in the tubular. The cutting blade is rotated a d a slot is formed through an azimuthal portion of the tubular by orbiting the cutting blade about an axis of the cutting tool and along a path having a radius along an azimuthal portion adjacent the slot that is greater than a radius along an azimuthal portion that is away from the slot. The method can further include cutting a control line disposed outside of the tubular by urging the cutting blade radially outward through the slot and into contact with the control line. Optionally included are the steps of identifying an azimuthal location of the control line, and orienting the cutting tool so that the azimuthal portion of increased radius of the path is aligned with the azimuthal location. The tubular can be removed from the wellbore. Optionally, the slot cal be repaired and fluid flowed through the tubular. In an example, the cutting blade is urged radially outward as the cutting blade orbits towards the slot and the cutting blade is retracted as the cutting blade orbits away front the slot, in an alternate embodiment, the radius of the path is maintained at a constant value on a side of the tubular opposite from the slot. The radii of the path along azimuthal positions adjacent the slot can increase with successive orbits of the cutting blade.

Also disclosed is a method of wellbore operations in a downhole tubular which includes providing a cutting tool having a main body, a cutting head on an end of the body, and a cutting blade on an end of the cutting head. The cutting tool is disposed into the tubular, and the cutting head rotated within the tubular so that the cutting blade orbits along a path within the tubular. The cutting blade is rotated with respect to the cutting head and the cutting blade is pivoted. radially outward as rotation of the cutting head urges the cutting blade towards the control line. The cutting blade is retracted radially inward as rotation of the cutting head urges the cutting blade away from the control line. The method can further include repeating the above steps until a slot is formed in the tubular and the cutting blade extends radially outward through the slot and cuts the control line. In an example, the path is acircular and has a radius when proximate the control line that is greater than the radius of the path when distal from the control line. The cutting blade may optionally be urged radially outward a greater distance with successive orbits. The method can further include identifying an azimuthal location of the control line and anchoring the cutting tool in a designated orientation for cutting the control line. Respective rotational speeds of the cutting head and cutting blade can remain substantially constant, and a radial feed rate of the cutting blade can be changed with respect to an azimuthal position of the path.

BRIEF DESCRIPTION OF THE SEVERAL VIEWS OF THE DRAWING

Some of the features and benefits of the present invention having been stated, others will become apparent as the description proceeds when taken in conjunction with the accompanying drawings, in which.

Figure 1:
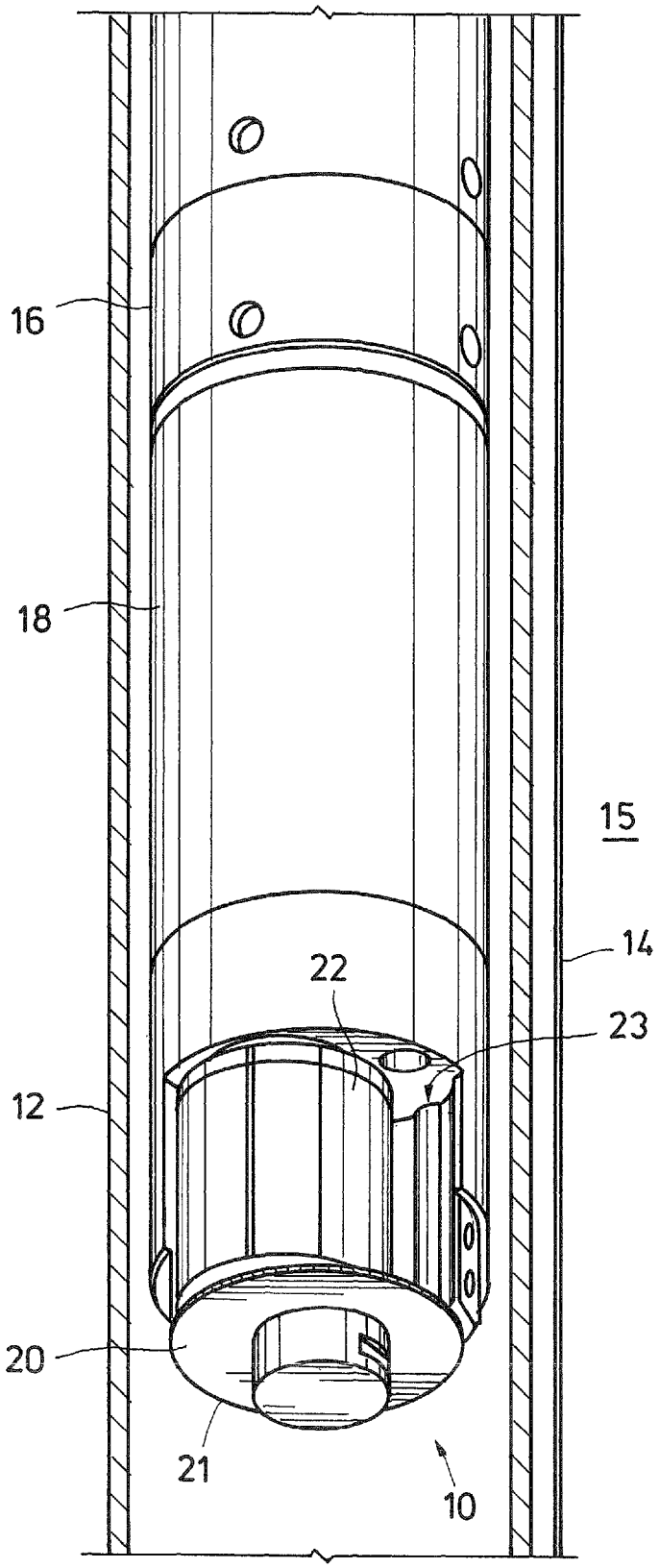
FIG. 1. is a partial sectional view of an example of a cutting tool inserted in a tubular in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

FIG. 1 provides a side perspective view of an example of a cutting tool 10 inserted within a downhole tubular 12. A control line 14 is shown outside of the tubular. The tubular 12 can be casing set in a wellbore 15, or tubing that depends into the wellbore 15, such as within a casing string. Examples of the control line 14 can be metal wires, fiber optics, fluid lines for hydraulic or pneumatic fluid, and the like. Signals through the control line 14 can include data from within the wellbore 15, or command signals from surface to equipment disposed in the wellbore. In the example of FIG. 1, the cutting tool 10 is substantially cylindrical and includes a main body 16; in which in one example houses a primary drive motor (not shown) for powering a cutting head 18 shown mounted on an end of the main body 16. A transmission (not shown) having shafts and gears may also be housed within the main body 16. Further in the example of FIG. 1, a circular cutting blade 20 is shown on an end of the cutting head 18 distal from the main body 16. Teeth 21 are formed on an outer periphery of the blade 20. A gearbox 22 is shown set in an opening 23 formed on a lower end of the cutting head 18. The gearbox 22, which is disposed in a housing, transmits a rotational force from a shaft (not shown) located substantially coaxial with the cutting head 18 to drive the blade 20. The shaft is powered by a motor (not shown), which also provides a rotational force for rotating the cutting head 18, where the motor is housed upward in the tool body 16.

Figure 2:
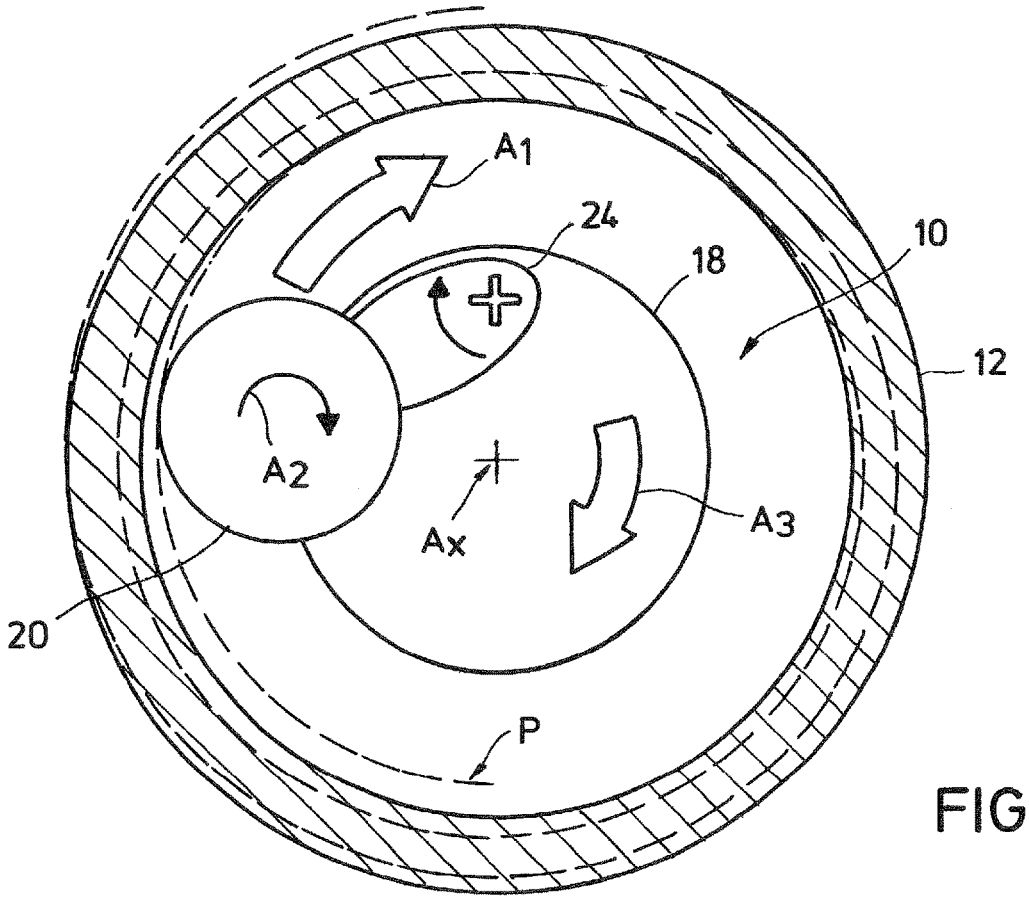
FIG. 2. is an axial sectional view of a cutting tool cutting a tubular in a wellbore.

Shown in FIG. 2 is an axial sectional view of the cutting tool 10 severing the tubular 12 in a traditional manner. In this example, a linkage means 24 is schematically illustrated that selectively pivots the blade 20 and gearbox 22 (FIG. 1) radially outward from an axis $A_X$ of the cutting tool 10 in a direction represented by arrow $A_1$. Powering the gearbox 22 in turn rotates the cutting blade 20 in a direction represented by arrow $A_2$. Selectively rotating the cutting head 18 in a direction represented by arrow $A_3$ as the linkage means 24 pivots the cutting blade 20 radially outward, moves the cutting blade 20 along a path P that spirals outward from the axis $A_X$. Continued rotation of the cutting head 18 and cutting blade 20 along with outward pivoting of the cutting blade 20, creates cutting contact between the blade 20 and tubular 12 that eventually severs the tubular 12 along its entire circumference. Example details of linkage means 24 can be found in one or more U.S. Pat. Nos. 7,802,949; 7,478,982; 7,575,056; 7,628,205; 7,987,901; and 8,113,271, all of which are incorporated by reference herein in their entireties for all purposes.

Figure 3:
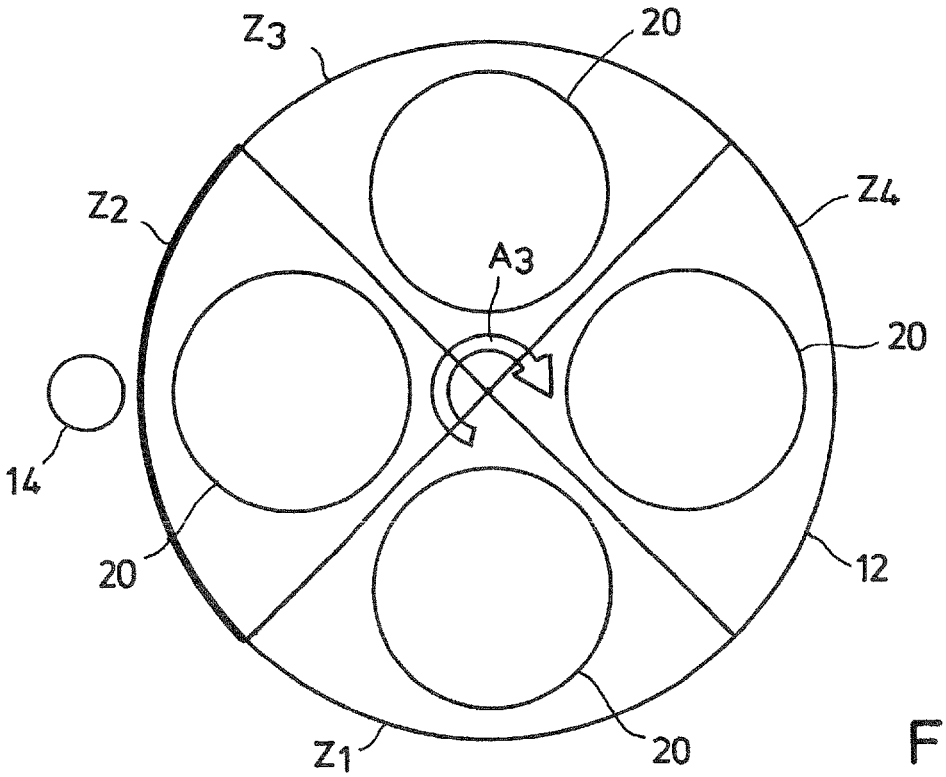
FIG. 3. is an axial partial sectional view of a schematic example of a cutting blade of the cutting tool of FIG. 1 in different azimuthal zones in the tubular in accordance with the present invention.

In an example of the method provided herein, the control line 14 is cut with the cutting blade 20. But unlike the traditional method described above, the tubular 12 is cut along a portion of its circumference instead of its entire circumference. In the example of FIG. 3, an axial sectional view is provided that schematically portrays positional snapshots of the cutting blade 20 as it orbits in a clockwise direction within the tubular 12 and along a path illustrated by arrow $A_3$. The tubular 12 is cordoned into angular portions that define zones $Z_1$-$Z_4$, shown offset from one another by an azimuthal angle. In the example of FIG. 3, zone $Z_2$ defines an azimuthal area adjacent control line 14. As such, in an example, the cutting blade 20 is projected radially outward when in zones $Z_1$, $Z_2$ and retracted radially inward when in zones $Z_3$, $Z_4$. Pivoting the cutting blade 20 outward as it approaches zone $Z_2$ and inward as it moves away from zone $Z_2$ limits contact between the cutting blade 20 and tubular 12 so that the tubular 12 is cut only along a portion of its circumference.

Figure 4:
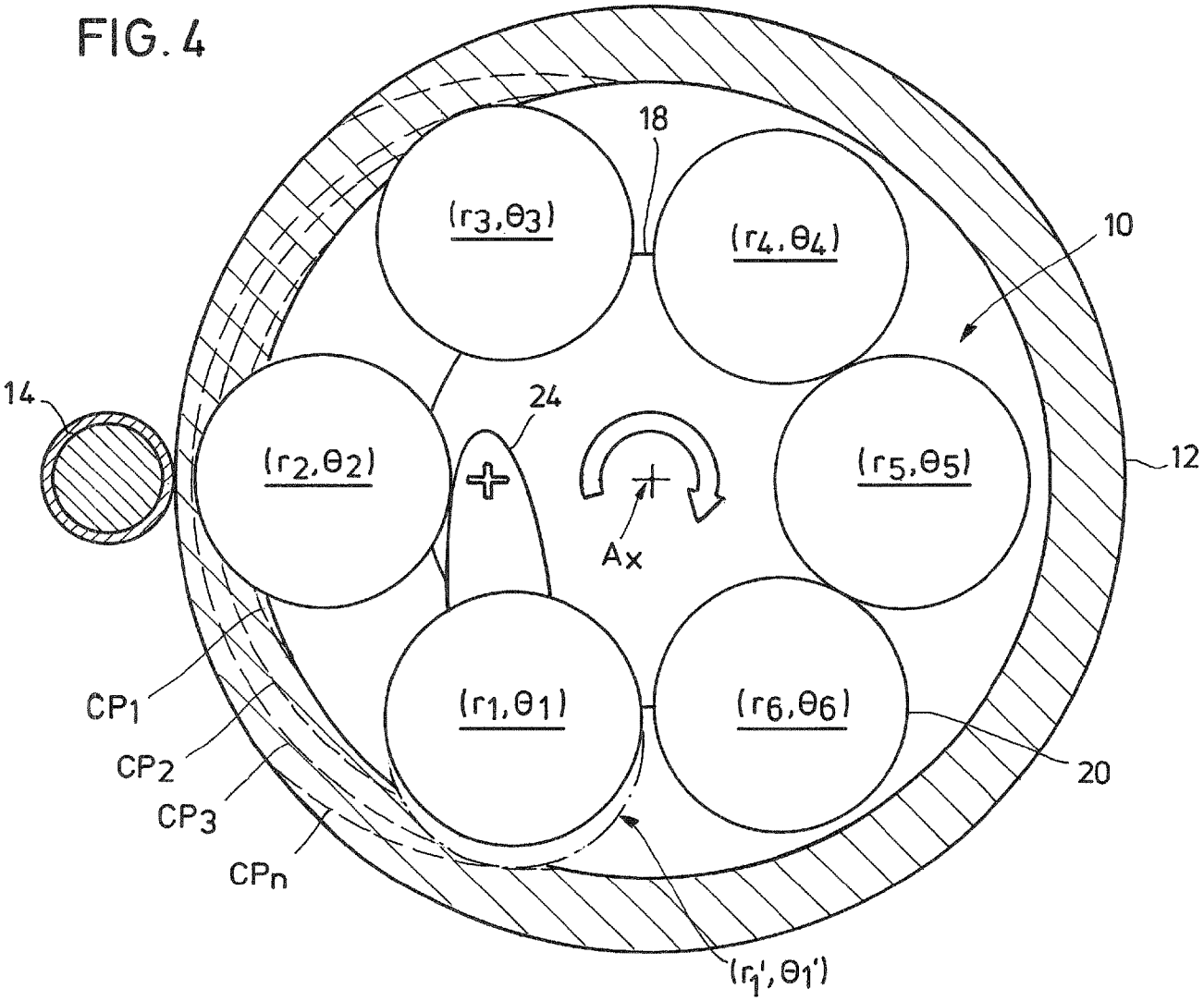
FIG. 4. is an axial partial sectional view of a schematic example of a cutting blade of the cutting tool of FIG. 1 in different azimuthal zones in the tubular and cutting paths in the tubular, in accordance with the present invention.

Referring now to FIG. 4, an example method of cutting the control line 14 is schematically shown in an axial partial sectional view. In this example, the cutting blade 20 is shown at various locations along its orbit within the tubular 12, where the locations are denoted by radial ($r_1$-$r_6$) and angular ($\theta_1$-$\theta_6$) coordinates that vary with respect to the axis $A_X$. In the example method shown in FIG. 4, when the angular location of the cutting blade 20 ranges from about $\theta_1$ to about $\theta_3$, it is maintained in cutting contact with the tubular 12; whereas when its angular location is at about $\theta_4$ to about $\theta_6$, the cutting blade 20 is retracted inward away from the wall of the tubular 12. As shown, the value of $r_2$ is greater than values of $r_1$ or $r_3$, and the value of $r_5$ is less than values of $r_4$ or $r_6$. Further in this example, with each orbit of the cutting blade 20 around the axis $A_X$, successive values of $r_1$-$r_3$ increase, while the values of $r_4$-$r_6$ can remain roughly the same. To illustrate the increased radial location with a successive orbit, a location of cutting blade 20 is shown in dashed outline at coordinates $r_1'$, $\theta_1$, where $r_1'$ is greater than $r_1$. Paths $CP_1$-$CP_n$ depict where the cutting blade 20 cuts through the tubular 12 with its subsequent orbits of varying radial location with respect to azimuthal angle.

EXAMPLE

In one non-limiting example of operating the cutting tool 10 of FIG. 4, when the cutting blade 20 is at angular locations $\theta_1$ and $\theta_2$ the blade 20 is urged radially outward at a rate of about 1 mm/minute; when at angular location $\theta_3$, the blade 20 is urged radially inward at a rate of about 200 mm/minute; at angular locations $\theta_4$ and $\theta_5$ the blade 20 is maintained at its radial location and inward from the inner wall of the tubular 12, when at angular location $\theta_6$, the blade 20 is urged radially outward at a rate of about 200 mm/minute so it can begin cutting when in the azimuthal zone adjacent the control line 14 when at about angular location $\theta_1$. Moreover, examples exist wherein the cutting head 18 rotates at about 10 rpm.

Figure 5:
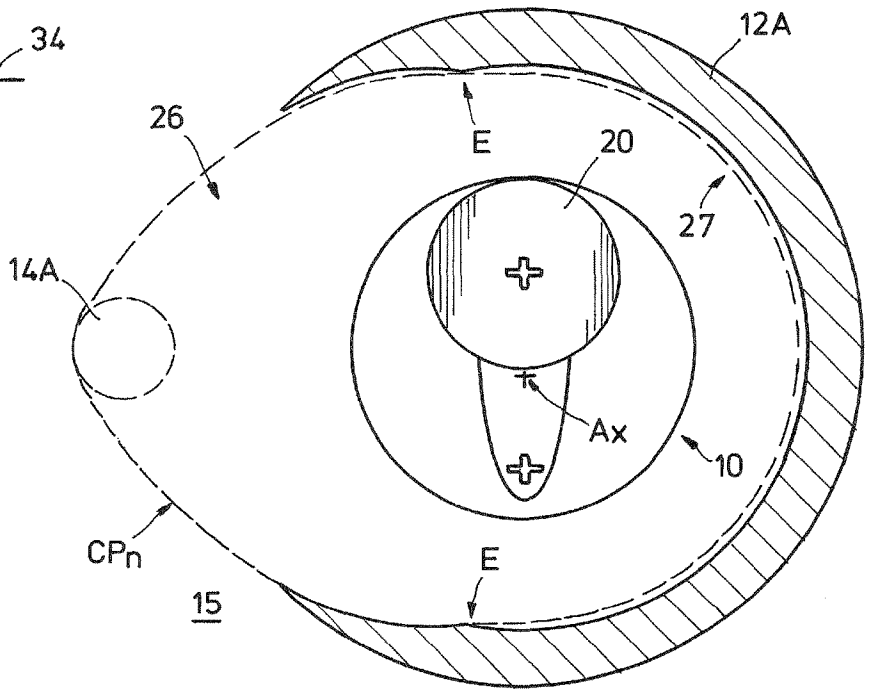
FIG. 5. is an axial sectional schematic view of the cutting tool and tubular of FIG. 1, with a slot in the tubular and a cut control line in accordance with the present invention.

Referring now to FIG. 5, a slot 26 is illustrated through a portion of the circumference of the tubular 124 through which the cutting blade 20 can extend radially outward and form a cut control line 14A. For the purposes of discussion herein, a cut in the control line 14 can extend fully across the control line 14, or a portion thereof. As the slot 26 is limited to a portion of the circumference of the tubular 12A, the entire tubular 12A can be removed from the wellbore 15 as a single member including portions of the tubular 12A below the slot 26. Optionally, the slot 26 can be covered, patched, or filled, thereby eliminating flow communication across the slot 26 so the tubular 12 can continue to be used as a conduit for flowing or storing fluid. This type of cutting operation assures that the control line 14 is severed at the same depth as the tubular 12 itself, which can prevent complications of a subsequent fishing operation. An embodiment of cutting path $CP_n$ is included in dashed outline that illustrates a curved albeit non-circular trajectory of the cutting blade 20. As shown, a distance between cutting path $CP_n$ and axis $A_X$ increases from proximate the terminal edges E of slot 26 and to adjacent cut control line 14A, Whereas along the portion of cutting path $CP_n$ between terminal edges E and an uncut portion 27 of tubular 12A, the distance between the axis $A_X$ and cutting path $CP_n$ remains relatively constant.

Figure 6:
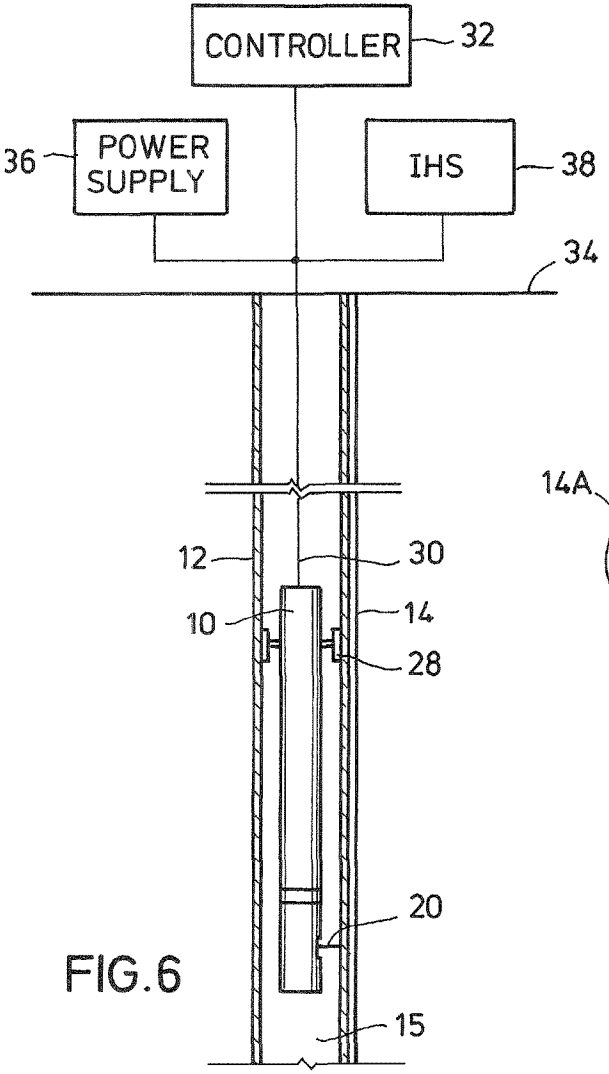
FIG. 6. is a side partial sectional view of an example method of the cutting tool cutting a control line outside the tubular of FIG. 1 in accordance with the present invention.

Shown in a side partial sectional view in FIG. 6 is an example of the cutting tool 10 in the tubular 12 with its cutting blade 20 extended radially outward into cutting contact with tubular 12. Further shown in this example embodiment are optional anchors 28 that engage an inner surface of the tubular 12 to retain the cutting tool 10 in the tubular 12. A wireline 30 is illustrated attached to an upper end of the cutting tool 10 for raising/lowering the tool 10 from and into the wellbore 15. The wireline 30 may also provide a communication link from a controller 32 provided on the surface 34 above an opening of the wellbore 15. Also on the surface 34 are a power supply 36, shown in communication with the cutting tool 10 via its connection to the wireline 30, and an information handling system (IHS) 38 in communication with the wireline 30. In one example, the IHS 38 stores and or processes information to and from the cutting tool 10.

The improvements described herein, therefore, are well adapted to carry out the objects and attain the ends and advantages mentioned, as well as others inherent therein. While presently preferred embodiments have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method of operating in a wellbore having a tubular comprising:

providing a cutting tool having a cutting blade;

deploying the cutting tool to a designated location in the tubular;

rotating the cutting blade;

forming a slot through an azimuthal portion of the tubular by orbiting the cutting blade about an axis of the cutting tool and along a path that is farther away from an axis of the cutting tool when along an azimuthal portion adjacent the slot, than when along an azimuthal portion that is away from the slot, and the distance of the path from the axis of the cutting tool when azimuthally adjacent the slot increases with successive orbits of the cutting blade.

2. The method of claim 1, further comprising cutting a control line disposed outside of the tubular by urging the cutting blade radially outward through the slot and into contact with the control line.

3. The method of claim 1, further comprising identifying an azimuthal location of the control line, and orienting the cutting tool so that the portion of the path farther away from the axis of the cutting tool is aligned with the azimuthal location.

4. The method of claim 1, further comprising removing the tubular from the wellbore.

5. The method of claim 1, further comprising repairing the slot and flowing fluid through the tubular.

6. The method of claim 1, the method further comprising urging the cutting blade radially outward as the cutting blade orbits towards the slot and retracting the cutting blade as the cutting blade orbits away from the slot.

7. The method of claim 1, wherein the radius of the path is maintained at a constant value on a side of the tubular opposite from the slot.

8. A method of wellbore operations in a downhole tubular comprising:

a. providing a cutting tool having a main body, a cutting head on an end of the body, and a cutting blade on an end of the cutting head;

b. disposing the cutting tool into the tubular;

c. rotating the cutting head within the tubular so that the cutting blade orbits along a path within the tubular;

d. rotating the cutting blade with respect to the cutting head;

e. pivoting the cutting blade radially outward as rotation of the cutting head urges the cutting blade towards the control line;

f. retracting the cutting blade radially inward as rotation of the cutting head urges the cutting blade away from the control line; and g. comprising identifying an azimuthal location of the control line and anchoring the cutting tool in a designated orientation for cutting the control line.

9. The method of claim 8, further comprising repeating steps (c)-(f) until a slot is formed in the tubular and the cutting blade extends radially outward through the slot and cuts the control line.

10. The method of claim 9, wherein the path is non-circular and when proximate the control line is farther away from an axis of the cutting tool than when distal from the control line.

11. The method of claim 8, wherein the cutting blade is urged radially outward a greater distance with successive orbits.

12. The method of claim 8, wherein respective rotational speeds of the cutting head and cutting blade remain substantially constant, and wherein a radial feed rate of the cutting blade changes with respect to an azimuthal position of the path.

13. A method of operating in a wellbore having a tubular comprising:

operating a cutting tool in the tubular, the cutting tool comprising a cutting blade;

rotating the cutting blade;

orbiting the rotating cutting blade along a path that circumscribes an axis of the tubular and that intersects an inner surface of the tubular along an azimuthal portion of the tubular that is adjacent to where a control line is disposed on an outer surface of the tubular;

forming a slot through the tubular with the cutting blade, the slot having an arc length with ends that are adjacent and on opposing sides of the control line; and extending the cutting blade radially through the slot and cutting the control line.

14. The method of claim 13, wherein the cutting blade follows a path that is radially more distal from an axis of the tubular when proximate the slot than when spaced away from the slot.

15. The method of claim 13, further comprising removing the tubular from the wellbore, including a section of the tubular that is on a side of the slot opposite from an opening of the wellbore.

* * * * *